US005197643A

United States Patent [19]

Augustin

[11] Patent Number: 5,197,643

[45] Date of Patent: Mar. 30, 1993

[54] TEXTILE RIPPING MACHINE

[76] Inventor: Werner Augustin, Uerdinger Strasse 2-8, D-4150 Krefeld, Fed. Rep. of Germany

[21] Appl. No.: 860,993

[22] Filed: Mar. 31, 1992

[30] Foreign Application Priority Data

Apr. 4, 1991 [DE] Fed. Rep. of Germany ..... 9104073

[51] Int. Cl.[5] ..... B26D 1/10; B26D 7/02

[52] U.S. Cl. ..... 225/93; 225/106; 83/614; 26/7

[58] Field of Search ..... 225/93, 106; 83/614, 83/939; 26/7, 10.4; 28/170

[56] References Cited

U.S. PATENT DOCUMENTS

| | | | |
|---|---|---|---|
| 1,186,504 | 6/1916 | Wagner | 26/7 |
| 2,573,034 | 10/1951 | Littlejohn | 225/93 |
| 2,591,394 | 4/1952 | Barth | 26/10.4 |
| 4,073,206 | 2/1978 | Gratsch et al. | 83/614 |
| 4,086,835 | 5/1978 | Frederick | 83/614 |
| 4,779,500 | 10/1988 | Bennett et al. | 83/614 |
| 4,833,957 | 5/1989 | Lundgren | 83/614 |

*Primary Examiner*—Frank T. Yost
*Assistant Examiner*—Scott A. Smith
*Attorney, Agent, or Firm*—Herbert Dubno; Andrew Wilford

[57] ABSTRACT

An apparatus device for ripping woven textile goods has a table having an upper surface, near and far longitudinal edges, and a transversely elongated slot extending between the edges and having transversely spaced near and far slot ends, the goods normally lying on the table extending across the slot. At least one outer rail extends transversely along the slot and at least one inner rail riding on the outer rail is displaceable therealong between a far end position projecting past the far slot end and a near end position projecting past the near slot end. A carriage displaceable substantially the full length of the inner rail is also displaceable between a far end position past the far slot end and a near end position past the near slot end. A ripping element on the carriage can be displaced on displacement of the carriage and inner rail between their end positions fully across the goods lying on the table across the slot to tear them weftwise.

11 Claims, 4 Drawing Sheets

TEXTILE RIPPING MACHINE

FIELD OF THE INVENTION

The present invention relates to a machine for ripping textile. More particularly this invention concerns such a machine used for preparing standard-size sections of textile goods for subsequent cutting and assembly.

BACKGROUND OF THE INVENTION

In the manufacture of articles made of woven textile fabric, a first stage in the production is normally the cutting of the textile that is delivered to the factory on rolled-up bolts up into standard-size sections . The standard-size sections are stacked up and gang cut into the individual pattern pieces, then the individual pieces are separated and sewn together.

The initial longitudinal subdivision of the elongated textile web into rectangular sections must be done perfectly parallel to the weft of the goods. Thus it is standard for the goods to be unrolled on a cutting table and for the worker to notch one of the selvedges and then rip the goods across, forming a perfect weft-wise tear.

Such a procedure must be done by expert skilled operators to avoid ruining valuable goods. It also is a bottleneck in a highly automated operation.

Thus devices have been proposed that facilitate the tearing operation. They typically must be built into a special-duty cutting table that is so very large that it extends at both longitudinal edges past the longitudinal selvedges of the fabric, making it hard for the operator to work at the table, especially when narrow goods need to be ripped.

OBJECTS OF THE INVENTION

It is therefore an object of the present invention to provide an improved ripping machine for woven textile goods.

Another object is the provision of such an improved ripping machine for woven textile goods which overcomes the above-given disadvantages, that is which can be built into a standard-width cutting table, and that even can be retrofitted to such a table.

SUMMARY OF THE INVENTION

An apparatus device for ripping woven textile goods according to the invention has a table having an upper surface, near and far longitudinal edges, and a transversely elongated slot extending between the edges and having transversely spaced near and far slot ends, the goods normally lying on the table extending across the goods. At least one outer rail extends transversely along the slot and at least one inner rail riding on the outer rail is displaceable therealong between a far end position projecting past the far slot end and a near end position projecting past the near slot end. A carriage displaceable substantially the full length of the inner rail is also displaceable between a far end position past the far slot end and a near end position past the near slot end. A ripping element on the carriage can be displaced on displacement of the carriage and inner rail between their end positions fully across the goods lying on the table across the slot to tear them weftwise.

Thus with this system the ripping element can move over a stroke that is actually longer than the width of the table. Thus goods can be positioned on the table covering its entire top and, indeed, even extending somewhat past the near table edge. The ripping element can move the entire width of the goods, but the device is still capable of being retrofitted into an existing cutting table that is normally dimensioned to be at most as wide as the widest goods being cut.

According to a further feature of the invention a mount connected between the table and the outer rail allows pivoting the rails, the carriage, and the ripping element between an upper position with the element above the upper table surface and a lower position with the element below the upper table surface. Thus in the lower position the device is completely out of the way so that the goods can easily be positioned on the table. The mount includes at least one arm having one end pivoted on the table and another end fixed to the outer rail and an expansible actuator braced between the rail and the table. The arm is below the table upper surface.

Normally according to the invention two such outer rails are normally positioned flush with the table upper surface and are each provided with at least two guides and two such inner rails riding in the guides are provided with stop plates interconnecting their ends. The carriage engages the respective stop plates in the respective end positions. This is an extremely simple telescoping arrangement that allows the extra-long stroke of the ripping element even though the apparatus is not transversely very long.

In this arrangement the guides are grooved wheels in which the inner rails are engaged and the carriage is provided with grooved wheels riding on the inner rails. The outer-rail wheels ride on the outside edges of the inner rails and the carriage wheels on the inside edges to keep the inner rails straight. Furthermore clamps are provided at the far table edge for holding the far selvedge of the goods and a cutter is provided between the longitudinally spaced clamps for notching the far selvedge of the goods. Thus all the operator need do is position the goods properly in the clamps, then start the successive and automatic operations of clamping, notching, and ripping.

In accordance with this invention the drive for the carriage includes a guide rail fixed relative to the outer rail and having a horizontal upper leg extending transversely of the table and a downwardly inclined lower leg, an arm having an upper end pivoted on the carriage and a lower end riding on the guide rail, and a motor having a flexible drive element connected to the arm for pulling it along the rail from the far table edge to the near table edge. The drive element is connected to the arm between the arm ends. When the arm is at the far table edge is it generally vertical and when it is at the near table edge it is generally horizontal.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
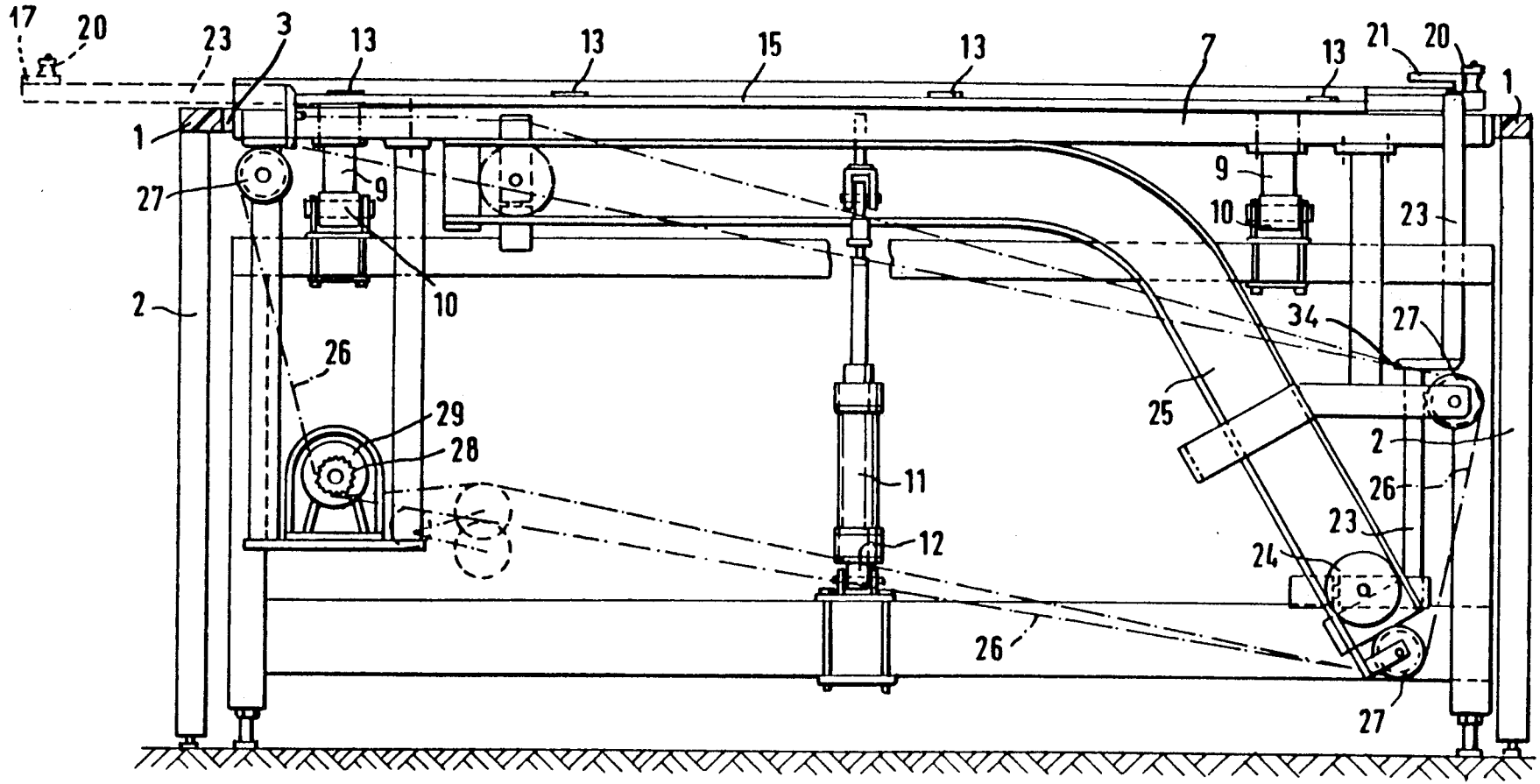
FIG. 1 is a small-scale end view of the apparatus according to the invention.

As seen in the drawing a horizontal cutting table 1 supported on a frame 2 is formed with, relative to a longitudinal warp direction L, a transversely elongated vertically through-going slot 3 that ends somewhat short of each longitudinal table edge. A ripping device 4 can project up through this slot 3, leaving a gap 6 along one edge of the slot 3 into which the edges of cut pieces 5 of fabric can hang after ripping.

Figure 5:
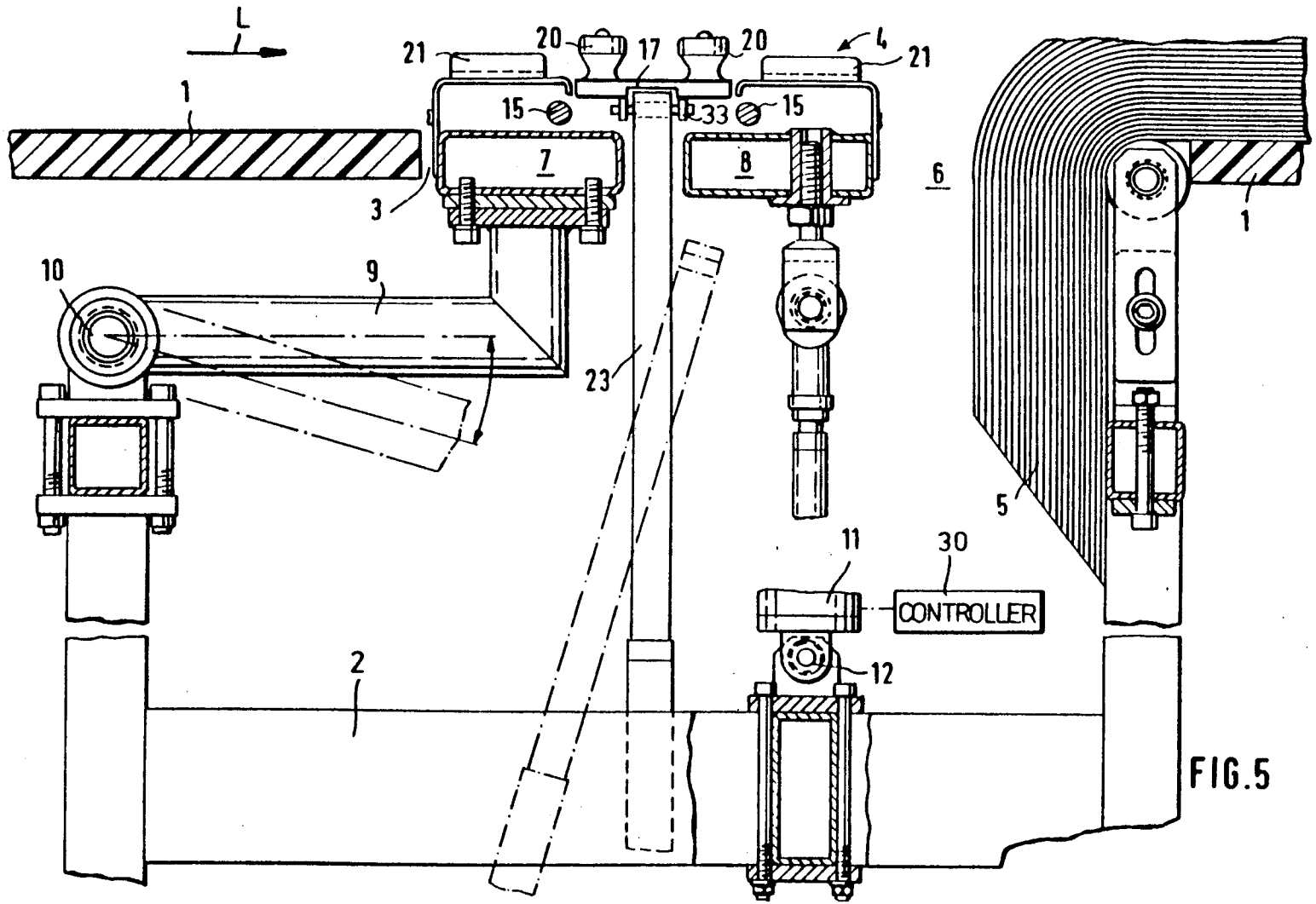
FIG. 5 is a longitudinal vertical section through a center part of the table of FIG. 1.

The ripping device 4 comprises a pair of outer guide rails 7 and 8 extending transversely substantially the full length of the slot 3 and having ends that are fixed together so they cannot move relative to each other. A pair of L-arms 9 have upper ends fixed to the upstream rail 7 and lower ends pivoted at 10 (See FIG. 5.) on the frame 2. A generally vertical cylinder 11 has an upper end pivoted on the downstream rail 8 and a lower end pivoted at 12 on the frame 2. Each rail 7 and 8 carries along its length four wheels 13 pivotal about a vertical axis and each formed with an outwardly open groove 14. Expansion and contraction of the double-acting cylinder 11 under the control of a control unit 30 can lift the rails 7 and 8 to the position illustrated in FIG. 5 where they are generally level with the table 1, and can pull then back down as indicated partly in dot-dash lines in FIG. 5 so that they are well below the table surface.

An inner frame comprised of two round-section rods 15 joined at their ends by stop plates 16 is engaged in the grooves 14 of the outer-frame wheels 13. A slide or carriage 17 is provided with four wheels 18 like the wheels 13 and having grooves 19 that engage outward with the rods 15 that in turn engage outward in the grooves 14 of the wheels 13. The carriage 17 carries on its upper surface a pair of waisted ripping rollers 20 spaced longitudinally apart. This carriage 17 and the frame 15, 16 can therefore move transversely from an end position extending past one longitudinal edge of the table 1 to an opposite end position extending past the opposite longitudinal edge of the table 1. On such movement the carriage 17 rolls along the rails 15 until it hits one of the plates 16, thereafter the inner frame 15, 16 rolls in the wheels 13.

The far table edge is equipped with two grippers each including a stationary upper jaw 21 and a lower jaw 31 that can be pressed up by a cylinder 22 operated by the controller 30. In addition this far table edge is provided with a notching cutter illustrated schematically at 32. The controller 30 can close the two grippers and then notch the far selvedge of the goods in one smooth operation.

An actuating arm 23 has an upper end pivoted at 33 about a longitudinal axis on the carriage 17 and a lower end provided with a wheel 24 riding in an L-shaped track 25 secured to the rails 7 and 8. An endless actuating chain 26 is connected at a central location 34 to the arm 23 and is spanned over idler rollers 27 mounted on the frame 2 and on the rail 25 and over a drive sprocket 28 carried on a motor 29 also carried on the frame 2. The controller 30 also operates the motor 29. The motor 29 can therefore pull the arm 23 from its vertical position shown in solid lines in FIG. 1 with the rollers 20 slightly outward past the far longitudinal side of the table 1 to a horizontal position shown in dot-dash lines in which the rollers 20 are well past the near edge of the table 1.

Figures 2, 3:
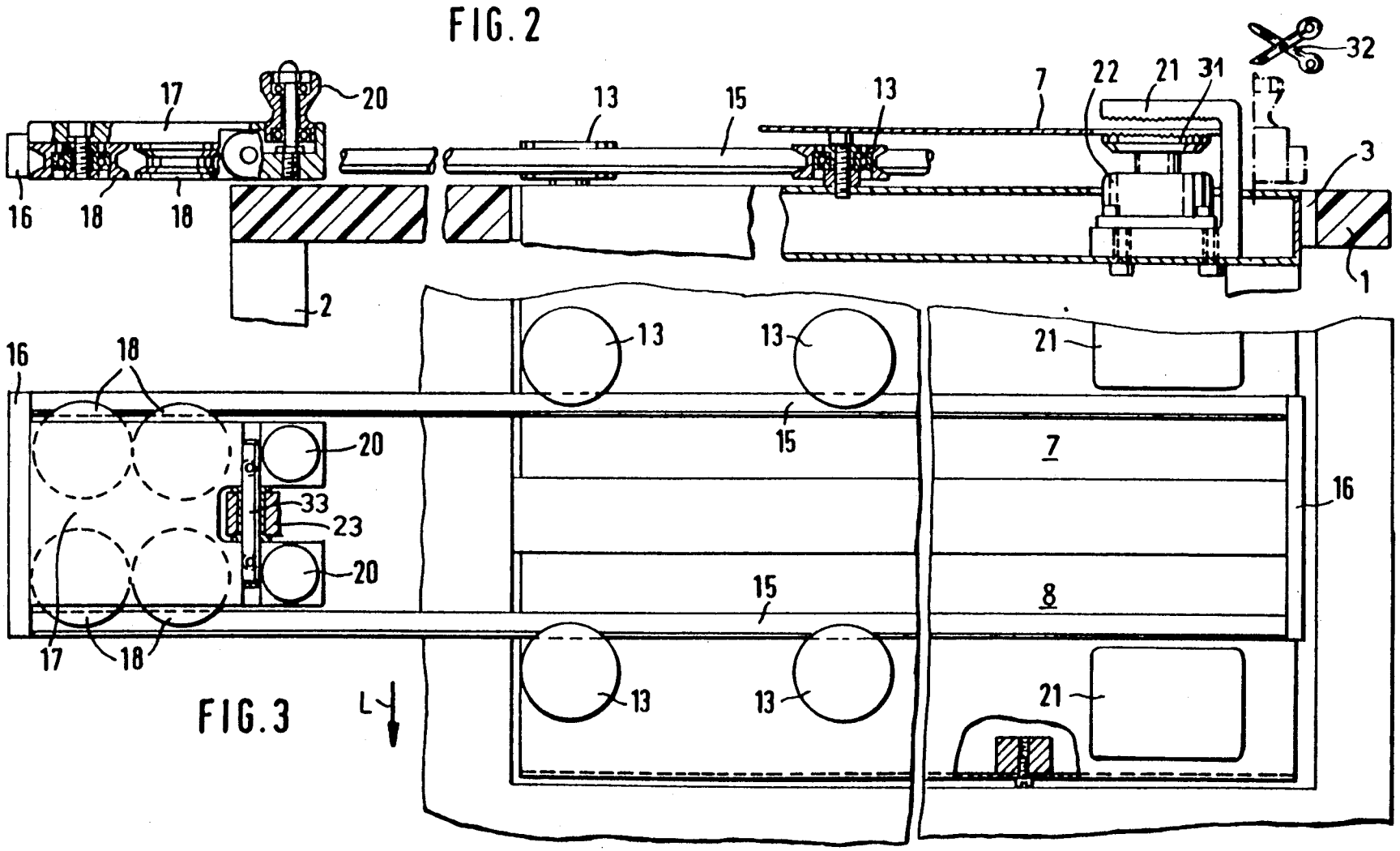
FIG. 2 is a large-scale sectional view through a detail of FIG. 1.
FIG. 3 is a top view of the structure shown in FIG. 2.
Figure 4:
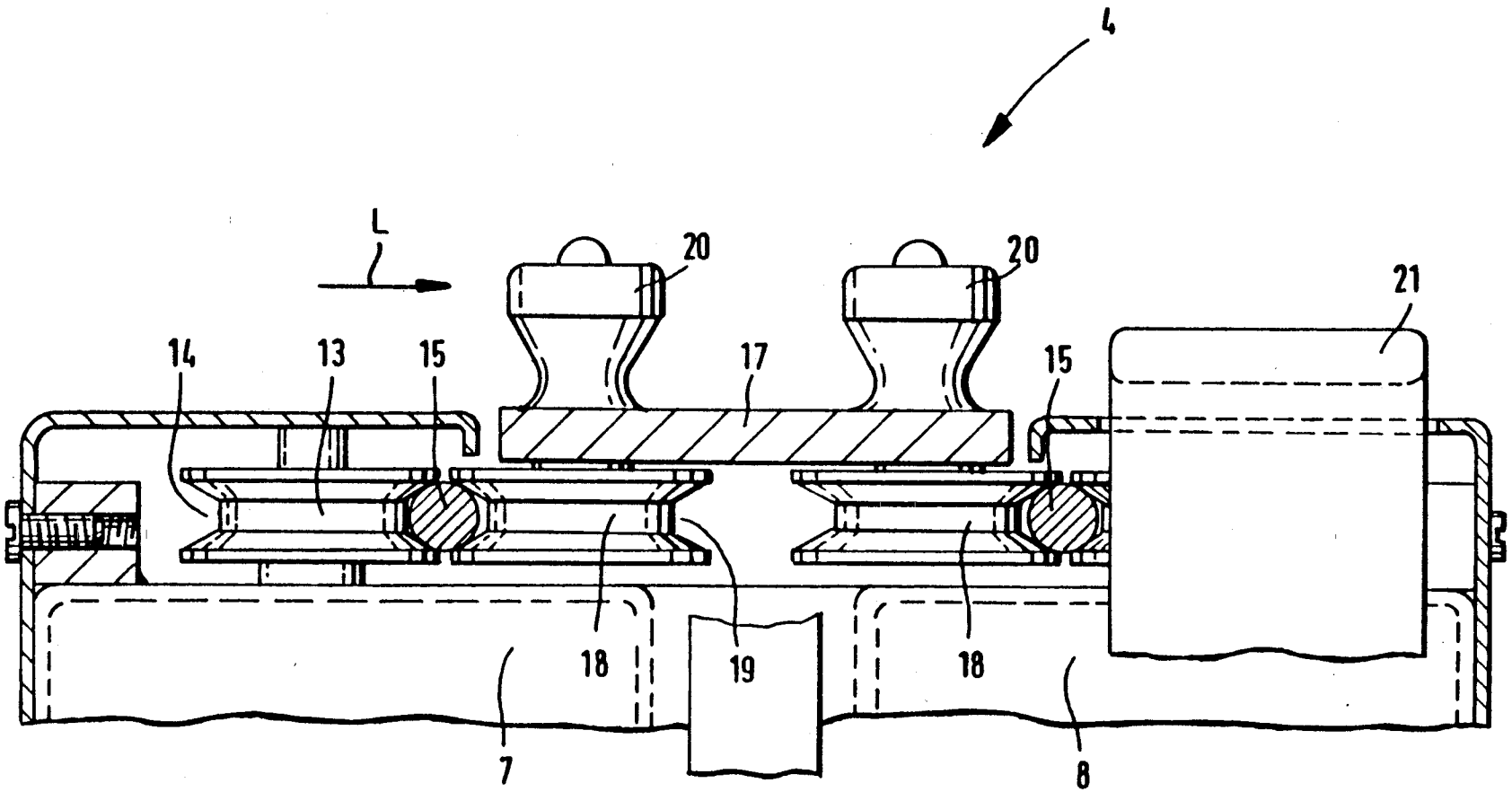
FIG. 4 is a larger-scale vertical section through the structure of FIGS. 2 and 3.

The machine described above is operated as follows:

To start with the cylinder is extended and the arm 23 is set to its generally upright position. This positions the entire ripping device 4 generally level with the upper surface of the table 1 with the rollers 20 somewhat outward of the far edge of the table 1 in the position shown in dot-dash lines in FIG. 2. In this position the textile 5 ca be pulled through the device with its far edge between the upper and lower gripper jaws 21 and 31. The desired tear location is accurately positioned between the upper jaws 21 level with the cutter 32 and the cylinders 22 are pressurized to solidly grip the selvedge, whereupon the cutter 32 is operated to notch the far selvedge edge The motor 29 then pulls the entire device 4 across the goods. The rollers 20 engage in the notch cut in the selvedge and, as the device 4 is pulled through, the fabric engages in the grooves of the rollers 20 to tear the fabric accurately across. Since in its extreme near-edge position the rollers 20 are well past the near table edge, goods can be torn that are substantially wider than the table 1.

Once the tear is complete the cylinder 11 is shortened so that the entire device 4 is dropped below the level of the upper surface of the table 1 and the motor 28 is reversed to move the device 4 back to the far table edge. Meanwhile a new piece of goods can be maneuvered o the table 1.

When the device 4 is all the way back at the far table edge, the cylinder 11 is extended and the cycle can be repeated.

I claim:

1. An apparatus device for ripping woven textile goods, the apparatus comprising:

a table having an upper surface, near and far longitudinal edges, and a transversely elongated slot extending between the edges and having transversely spaced near and far slot ends, the goods normally lying on the table extending across the slot;

at least one outer rail extending transversely along the slot;

at least one inner rail riding on the at least one outer rail and displaceable therealong between a far end position projecting past the far slot end and a near end position projecting past the near slot end;

a carriage displaceable substantially the full length of the at least one inner rail and also displaceable between a far end position past the far slot end and a near end position past the near slot end;

a ripping element on the carriage; and drive means for displacing the carriage and at least one inner rail between their end positions for ripping the goods lying on the table across the slot.

2. The ripping apparatus defined in claim 1, further comprising mounting means connected between the table and the at least one outer rail for pivoting the at least one inner and outer rails, the carriage; and the ripping element between an upper position with the ripping element above the upper table surface and a lower position with the ripping element below the upper table surface.

3. The ripping apparatus defined in claim 2 wherein the mounting means includes at least one arm having one end pivoted on the table and another end fixed to the at least one outer rail, and an expansible actuator braced between the at least one outer and the table.

4. The ripping apparatus defined in claim 3 wherein the at least one arm is below the table upper surface.

5. The ripping apparatus defined in claim 1 wherein the apparatus comprises two such outer rails normally positioned flush with the table upper surface and each, provided with at least two guides, and two such inner rails riding in the guides and provided with stop plates interconnecting their ends, the carriage engaging the respective stop plates in the respective end positions.

6. The ripping apparatus defined in claim 5 wherein the guides are grooved wheels in which the inner rails are engaged and the carriage is provided with grooved wheels riding on the inner rails.

7. The ripping apparatus defined in claim 1, further comprising means at the far table edge for clamping a far selvedge of the goods; and means at the clamping means for notching the far selvedge of the goods.

8. The ripping apparatus defined in claim 1 wherein the drive means includes:

a guide rail fixed relative to the at least one outer rail and having a horizontal upper leg extending transversely of the table and a downwardly inclined lower leg, an arm having an upper end pivoted on the carriage and a lower end riding on the guide rail, and motor means having a flexible drive element connected to the arm for pulling it along the rail from the far table edge to the near table edge.

9. The ripping apparatus defined in claim 8 wherein the drive element is connected to the arm between the arm ends.

10. The ripping apparatus defined in claim 8 wherein when the arm is at the far table edge it is generally vertical and when it is at the near table edge it is generally horizontal.

11. An apparatus device for ripping woven textile goods, the apparatus comprising:

a table having an upper surface, near and far longitudinal edges, and a transversely elongated slot extending between the edges and having transversely spaced near and far slot ends, the goods normally lying on the table extending across the slot;

a pair of longitudinally spaced outer rails extending transversely along the slot;

a pair of longitudinally extending inner rails riding on the outer rails and displaceable therealong between a far end position projecting past the far slot end and a near end position projecting past the near slot end;

a carriage displaceable substantially the full length of the inner rails and also displaceable between a far end position past the far table edge and a near end position past the near table edge;

a ripping element on the carriage;

drive means for displacing the carriage and inner rails between their end positions for ripping the goods lying on the table across the slot; and means connected between the outer rails and the table for pivoting the inner and outer rails, carriage, and ripping element between an upper position with the inner rails, carriage, and ripping element above the upper surface of the table and a lower position therebelow.

* * * * *